US005361986A

United States Patent [19]

Meier et al.

[11] Patent Number: 5,361,986

[45] Date of Patent: Nov. 8, 1994

[54] ARRANGEMENT FOR LAYING RAIL

[75] Inventors: Peter Meier, Sevelen, Switzerland; Klaus Wechselberger, Feldkirch, Austria; Ralf Ludwig, Sennwald, Switzerland

[73] Assignee: Hilti Aktiengesellschaft, Furstentum Liechtenstein, Germany

[21] Appl. No.: 67,458

[22] Filed: May 25, 1993

[30] Foreign Application Priority Data

Jun. 13, 1992 [DE] Germany ..... 4219472

[51] Int. Cl.[5] ..... E01B 9/00

[52] U.S. Cl. ..... 238/283; 238/382

[58] Field of Search ..... 238/382, 283, 2, 3, 238/4, 5, 6, 7, 8; 267/153, 141

[56] References Cited

U.S. PATENT DOCUMENTS

| | | | |
|---|---|---|---|
| 2,770,421 | 11/1965 | Wilson | 238/283 |
| 4,216,904 | 8/1980 | Vivion | 238/25 |
| 4,925,094 | 5/1990 | Buekett | 238/283 |
| 5,165,598 | 11/1992 | Ortwein | 238/283 |

FOREIGN PATENT DOCUMENTS

| | | | |
|---|---|---|---|
| 0871555 | 5/1971 | Canada | 238/382 |
| 0105950 | 4/1984 | European Pat. Off. | 238/382 |
| 0467863 | 1/1992 | European Pat. Off. | 238/382 |
| 3935354 | 4/1991 | Germany | 238/382 |

*Primary Examiner*—Mark T. Le

*Attorney, Agent, or Firm*—Anderson Kill Olick & Oshinsky

[57] ABSTRACT

In an arrangement for laying rail in a railroad track over which railway cars travel, the rails (1) include a lower base flange (1*a*) and an upper rail head (1*b*). A molded elastic bearing part (5) is positioned between the lower support member (4) and an upper support plate (3). The elastic part (5) has at least two elements each inclined in the same direction but at different angles to the plane of the track. Extensions of the elements have a common intersection (S) located above the rail flange (1*a*) on an outer side of the track. As a result, when a load is applied to the track, a circular pivoting motion of the rail takes place about the common intersection (S). Due to the circular pivoting motion the rail head (1*d*) moves essentially only in the vertical direction, whereby gauge widening does not occur in the rail track when railway cars travel over curved sections of the track.

11 Claims, 3 Drawing Sheets

ARRANGEMENT FOR LAYING RAIL

BACKGROUND OF THE INVENTION

The present invention is directed to an arrangement for laying rail in a railroad track where the rail includes a lower rail flange and an upper rail head with an elastic bearing member located between the rail flange and the bearing or support member for the track.

Shock loads of different intensity, noise and especially transverse forces on curves occur when railway cars travel over railroad track, depending on the weight of the cars and their travel velocity. Support installations are known including a molded elastic part located, for the most part indirectly, between the based rail flange and the bearing area of the track.

In addition to the loads resulting from the weight of the railway car, high transverse forces due to the guidance loads of the railway cars occur especially in curved sections of the railroad track. By positioning the molded elastic part between the rail flange and a bearing or support member, the vertical mobility characteristic of a support plate supporting the rail flange can be controlled when a load is applied to the rail. The shape of the elastic part determines its elastic behavior.

An intermediate rubber elastic plate for rail attachment is disclosed in DE-PS 2 210 741 used especially for laying rail without the use of ties, where the bearing pressure of the rail is transmitted by the intermediate plate to the subsoil.

The intermediate plate has inside channels extending at uniform and non-uniform spaces parallel to the long direction of the rail for effecting the elastic behavior of the intermediate plate. Accordingly, the intermediate plate is more elastic in the region of each channel and can be more easily compressed in this region. Viewed in cross-section, the channels are arranged on a central axis in such an intermediate plate and form a core zone located between two outer edge zones.

Such an intermediate rubber elastic plate has the disadvantage that parallel compression occurs in case of vertical loading. With additionally occurring transverse forces, the outer edge zone facing the rail moves relative to the outer edge zone facing the subsoil parallel towards the outer side of the rail. As a result, an offset of the rail occurs in the vertical as well as the in the horizontal direction. Accordingly, a considerable gauge widening of the railroad track occurs, which can result in increased risk of derailment especially in case of rail fracture in curved rail sections.

SUMMARY OF THE INVENTION

Therefore, the primary object of the present invention is to provide an arrangement for laying rail assuring the maintenance of the gauge in curved sections, independently of the loading.

In accordance with the present invention, an elastic bearing member has at least two generally upwardly extending elements each inclined at a different angle to the plane of the railroad track with the elements forming extensions or rays meeting at a common intersection. The inclination or angle of these elements is variable or different in a plane extending essentially at right angles to the axis of the rails or plane of the railroad track and the common intersection is located on an outer side of the track higher than the rail flange.

The inclined elements located, if necessary indirectly, between the rail flange and the subsoil react to a vertical loading by a change in their inclination relative to the plane of the railroad track. As a result, a circular support or movement of the rail around the common intersection of the inclined elements is achieved.

When a railway car travels over the track there is a tendency, particularly in curved sections, for a horizontal offset of the rail towards the outer side of the track along with a vertical subsidence, where the vertical subsidence is greater on the side of the rail facing towards the center of the railway track than on the side facing the outer side of the track. A pivoting motion of the rail head occurs towards the center of the track due to the greater subsidence of the rail on the center or inner side. The horizontal offset of the rail head towards the center of the track arising in the course of such pivoting motion compensates for the tendency of the horizontal offset of the rail towards the outer side of the track.

When traveling over such an arrangement, only a vertical subsidence of the rail head occurs. No gauge widening takes place.

The angle between the plane of the railroad track and the inclined elements is preferably in the range of 5° to 85°. These elements can be inclined relative to the plane of the railroad track as a function of the location of the common intersection of the extensions of the element and of the width of the elastic bearing member or part extending perpendicularly to the long direction of the rail as well as the spacing between the at least two inclined elements.

Preferably, the elements are formed by laterally spaced webs of a molded elastic part. The elastic part is formed of a core zone made up of the spaced webs, and two outer edge zones one disposed between the core zone and the rail flange and the other between the core zone and the bearing or support region for the track. By configuring the outer or upper and lower edge zones and the webs as a single molded part, an elastic joint-like attachment of the webs to the upper and lower edge zones is obtained.

When a load is applied a tilting of the webs takes place towards the outer side of the track. The upper edge zone facing the rail flange is displaced relative to the lower edge zone facing the subsoil or support region towards the outer side of the track and is pressed in the region closer to the center of the track against the lower edge zone facing the support area.

The rail resting on the molded elastic part, if necessary with the interposition of a support plate, executes a circular movement around the common intersection of the inclined webs. When a railway car travels over a rail supported by such a bearing arrangement, the rail head only subsides in the vertical direction.

In one preferred embodiment the elements or webs are formed as rocking bars. The contact points at which the rocking bars are connected to the support area and the rail flange can be designed possibly in a hinge-like manner. Therefore, the flange moves in a guided and constrained manner around the hinges disposed in the support area of the distance present by the rocking bars. The rocking bars thus assure vertical subsidence of the rail head, if the vertical load or a load acting obliquely from the top is applied to the rail head. An elastic element for corresponding essentially vertical dampening, if necessary, is disposed between the rail flange and the support area.

Preferably, the rocking bars are embedded in a molded elastic part. To change specific elastic properties in a molded part, the bars in the form of filling members are inserted into open spaces between the webs extending essentially in the long direction of the rails. The filling members have a lower elasticity than the material of the molded part. The webs disposed between the bars or filling members no longer provide a support function, rather they serve as elastic abutments between the individual bars or filling members.

It is possible to position the elastic bearing member or part directly between the rail flange and the support area or subsoil. In such an arrangement the rail is preferably attached by elements to the elastic support or bearing member.

In another embodiment of the elastic bearing member, a support plate is located between the rail flange and the elastic bearing member. The support plate is selected sufficiently strong for receiving the attachment elements serving to secure the rail on the support plate. The elements contacting the support plate and the elastic bearing member only have the function of keeping the arrangement together as a component and to carry the vertical forces which develop. To dampen the sideways and vertically upwardly directed motion of the support plate, elastic guide elements are provided along opposite sides of the plate and, if necessary, elastic stabilizers are arranged overlapping the plate.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there are illustrated and described preferred embodiments of the invention.

DETAILED DESCRIPTION OF THE INVENTION

Figure 1:
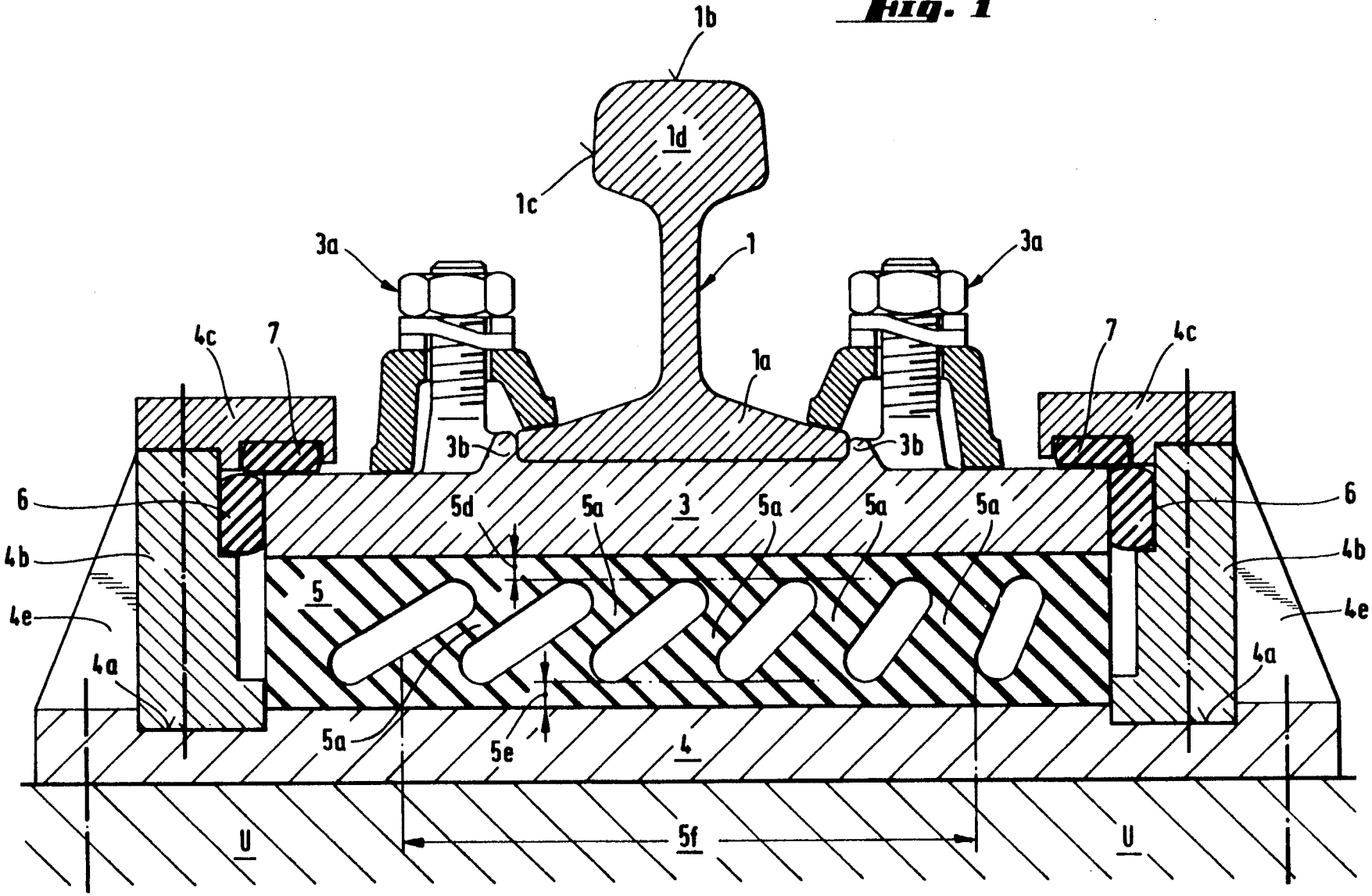
FIG. 1 is a transverse sectional view of an arrangement embodying the present invention in the unloaded condition.
Figure 2:
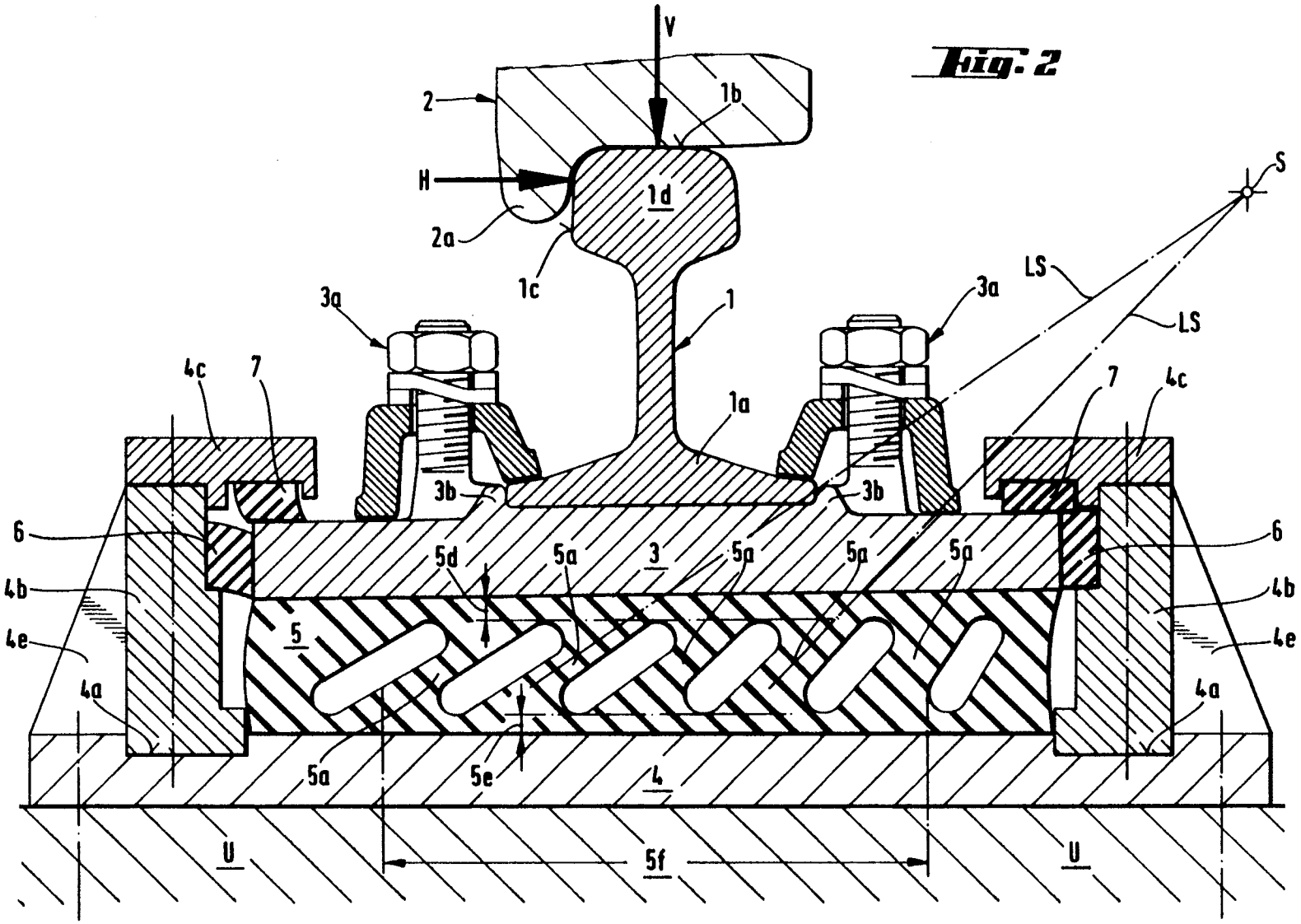
FIG. 2 is a view similar to that in FIG. 1, however, with the arrangement shown in the loaded condition.
Figure 3:
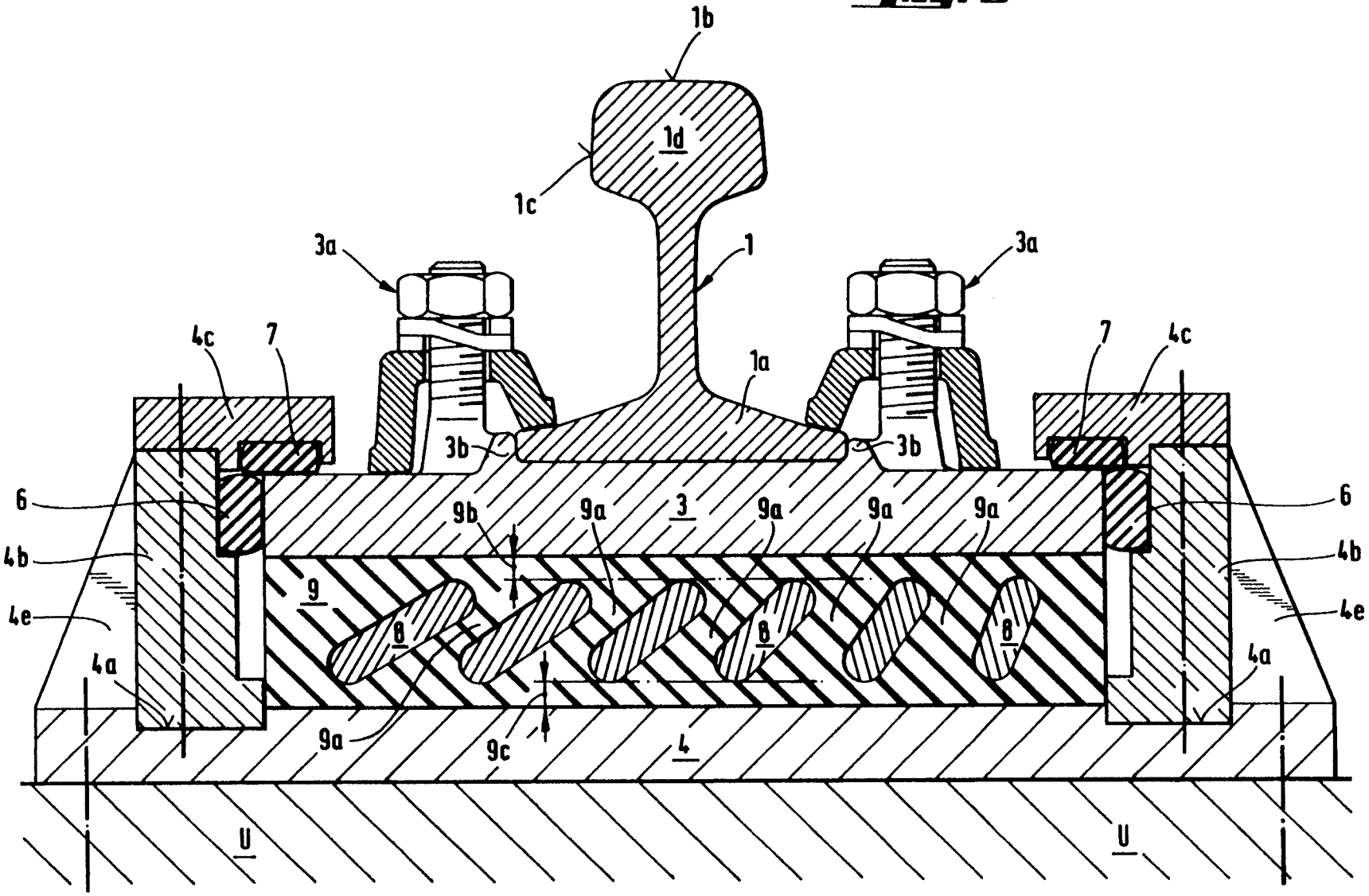
FIG. 3 is transverse view similar to FIG. 1 of another arrangement in the unloaded condition embodying the present invention.

FIGS. 1 to 3 show an arrangement for supporting rail including a rail 1 with a lower rail flange 1*a*, an upper rail head 1*b* with side flanks 1*c* and an end face or section 1*d*. Rail 1 is fastened on a support plate 3 by fastening elements 3*a*. Horizontal side guidance of the rail 1 is afforded by projections 3*b* extending upwardly from the top side of the support plate 3.

A molded elastic part or support member 5 (FIGS. 1 and 2) or 9 (FIG. 3) rests on a bearing or support member 4 secured to the subsoil U by anchoring elements shown schematically in FIGS. 1 to 3. The support member 4 has recesses 4*a* in its face directed toward the rail 1 with the recesses extending in the long direction of the rail. Recesses 4*a* receive upwardly extending guide strips 4*b* for limiting, at least partially, sideways movement of the arrangement. The guide strips 4*b* are located along the sides of the elastic part or support member 5 and the support plate 3 and extend in the long direction of the rail. In the region of the support plate 3 the guide strips 4*b* have recesses in which elastic guide elements 6 fit.

Parts 4*c* are located on the upper ends of the side guide strips 4*b* and these parts have a recess in which elastic stabilizers 7 are fitted. The elastic guide elements 6 and the elastic stabilizers 7 are shaped so that they extend for at least a part of the entire length of the arrangement in the long direction of the rail. The part 4*c* and the guide strips 4*b* are connected with the bearing or support member 4 by fastening elements shown only schematically.

The outer sides of guide strips 4*b* have reinforcement ribs 4*e* abutting against the upper face of the bearing member 4. Accordingly, transverse forces developing, especially when traveling over curved rail sections, can be more easily diverted through the bearing member 4 into the subsoil U.

To provide this arrangement for laying rail with appropriate resistance against slippage of the rail, the support plate 3 is shaped so that it extends beyond the bearing member 4 in the long direction of the rail and this extending section, not shown, extends vertically downwards and overlaps the bearing member 4 at least partially. Further, though not shown, elastic elements are disposed between the downwardly extending section of the support plate 3 and the bearing member 4 for elastically compensating for slippage of the rail. As mentioned above, the overlapping of the bearing member 4 by the support plate 3 in the long direction of the rail is not illustrated in the drawing.

Molded elastic part 5 is formed of an upper edge zone 5*d* and the lower edge zone 5*e* with a core zone 5*f* extending between the upper and lower zones and being made up of webs 5*a*, note FIGS. 1 and 2. Webs 5*a* are inclined so that ray-shaped extensions LS of the web have a common intersection S located on an outer side of the track with the center point located above the rail flange 1*a*. Webs 5*a* closer to the center of the track form a smaller angle with the plane of the railroad track than do the webs 5*a* closer to the outer side of the arrangement.

FIG. 2 shows the arrangement for laying rail 1 in the loaded condition where a wheel 2 of a railway car, not shown, bears against the upper face 1*b* of the rail with the wheel flange 2*a* contacting the side flange 1*c* of the rail head 1*d*. As viewed in the drawing, the right side of the rail is on the outer side of the track and the left side of the rail faces toward the center of the track. Horizontal loads H and vertical loads V of proportionate weight, composed of the weight of the railway car and the weight of the load it carries, are transferred by the wheel 2 to the rail head 1*d* of the rail 1.

The load on the rail head 1*d* causes a deformation of the molded elastic part 5. The differently inclined webs 5*a* result in a displacement of the upper edge zone 5*d* facing the support plate 3 relative to the lower edge zone 5*e* contacting the bearing member 4 towards the outer side of the railroad track. Simultaneously, there is a vertical deformation of varying amounts of the molded elastic part 5.

In the region where the webs 5*a* form a smaller angle relative to the plane of the railroad track, a larger vertical deformation occurs than in the region where the webs form a relatively larger angle with the plane of the railroad track. Accordingly, a larger vertical subsidence takes place in the region of the molded elastic part 5 closer to the center of the track.

The parallel displacement of the upper and lower edge zones 5*d*, 5*e* relative to one another and the variable strong subsidence of the molded elastic part 5 can be controlled to the extent that the position of the rail head 1*d* changes only in the vertical direction V when railway cars travel over the rail 1 supported by this arrangement. As a result, there is no widening of the rail gauge.

In the case of a large subsidence along one side of the elastic part 5 when the load is applied, a tilting motion of the rail 1 takes place and the rail head 1*d* moves slightly towards the center of the track. To compensate for this horizontal offset of the rail head 1*d*, a constrained displacement of the upper and lower edge zones 5*d*, 5*e* against each other is caused by the webs 5*a* disposed at different inclinations or angles.

Another embodiment of the arrangement is shown in FIG. 3 where a molded elastic part 9 has stable rocking bars 8 and is positioned between the support plate 3 and the bearing member 4. The rocking bars 8 are arranged at different angles relative to the plane of the railroad track. Extensions LS, as shown in FIG. 2, of the rocking bars have a common intersection S located above the base flange la on the outer side of the track. The webs 9*a* located between the rocking bars 8 deform when a load is applied. Elastic part 9 with the rocking bars 8 provides the ability to carry higher loads and to control more precisely the shifting or displacement of the upper and lower edge zones 9*b*, 9*c* of the part 9. The rocking bars 8 embedded in part 9 may be formed of metal, such as light metal, or of plastics material, rubber and wood.

In another possible embodiment, not shown, the molded elastic part can be provided in the spaces between the webs with a medium having no inherent stability in place of the rocking bars 8. Such an arrangement affords the possibility of using gas, air or liquid as dampening materials.

With such dampening elements, it is possible to influence the elastic behavior of an arrangement for laying rails 1 in different ways, so that the elastic properties can be preset, especially in curved sections.

While specific embodiments of the invention have been shown and described in detail to illustrate the inventive principles, it will be understood that the invention may be embodied otherwise without departing from such principles.

We claim:

1. An arrangement for laying a rail in a railroad track used for supporting railway cars, the railroad track having a generally horizontal plane over which the railway cars travel, comprising a rail (1) having a long axis, a rail flange (1*a*) forming a rail base and a rail head (1*b*) spaced upwardly from the rail flange, said rail extending generally horizontally, a generally horizontally arranged bearing member (4) for bearing on a sub-soil base, a generally horizontally arranged elastic support member (5, 9) located between said bearing member (4) and said rail flange (1*a*) wherein the improvement comprises that said elastic support member (5,9) includes at least two generally upwardly extending laterally spaced elements each inclined at a different angle to the railroad track plane, extensions of said elements extend to a common intersection (S), and the angles of said elements being different in a plane perpendicular to the long axis of said rail of the railroad track plane and the common intersection (S) located above the rail flange on an outer side of the railroad track.

2. An arrangement, as set forth in claim 1, wherein the angle of said elements relative to the railroad track plane are in the range of 5° to 85°.

3. An arrangement, as set forth in claims 1 or 2, wherein said elements are formed by laterally spaced webs (5*a*) of a molded said elastic support member (5).

4. An arrangement, as set forth in claims 1 or 2, wherein said elements are formed as rocking bars (8).

5. An arrangement, as set forth in claim 4, wherein said rocking bars (8) are embedded in a molded said elastic support member (9) and are spaced apart by webs of said elastic part.

6. An arrangement, as set forth in claim 3, wherein a generally horizontally arranged support plate (3) has an upper surface and a lower surface with said rail flange bearing on said upper surface and said molded elastic support member (5) bearing against said lower surface, and said bearing member (4) supporting a lower surface of said elastic support member (5).

7. An arrangement, as set forth in claim 6, wherein said bearing member (4) includes an upwardly extending guide strip (4*b*) extending along each of the opposite sides of said elastic support member (5), and elastic guide elements (6) and elastic stabilizers (7) located between said guide strips (4*b*) and said support plate (3).

8. An arrangement, as set forth in claim 5, wherein a generally horizontally arranged support plate (3) has an upper surface and a lower surface with said rail flange bearing on said upper surface and said molded elastic support member (9) bearing against said lower surface, and said bearing member (4) supporting a lower surface of said elastic support member (9).

9. An arrangement, as set forth in claim 8, wherein said bearing member (4) includes upwardly extending guides extending along opposite sides of said elastic support member (9), and elastic guide elements (6) and elastic stabilizers (7) located between said guide strips (4*b*) and said support plate (3).

10. An arrangement, as set forth in claim 7, wherein said at least two elements having different angles with said element closer to a center of the railroad track having a greater angle than the element more remote from the center of the railroad track.

11. An arrangement, as set forth in claim 9, wherein at least two elements having different angles with said element closer to a center of the railroad track having a greater angle than the element more remote from the center of the railroad track.

* * * * *